US005272966A

United States Patent [19]

Dixon

[11] Patent Number: 5,272,966

[45] Date of Patent: Dec. 28, 1993

[54] METHOD FOR BUNDLING NEWSPAPERS

[76] Inventor: Richard W. Dixon, 7829 Cessna Ave., Gaithersburg, Md. 20879

[21] Appl. No.: 53,158

[22] Filed: Apr. 27, 1993

Related U.S. Application Data

[62] Division of Ser. No. 931,398, Aug. 18, 1992.

[51] Int. Cl.[5] ..... B65B 13/02

[52] U.S. Cl. ..... 100/2; 53/592; 53/399; 100/34; 100/212; 211/50

[58] Field of Search ..... 100/1, 2, 34, 212; 53/399, 390, 592; 206/44 B, 451; 211/50, 51, 70, 72; 220/DIG. 13

[56] References Cited

U.S. PATENT DOCUMENTS

| | | | |
|---|---|---|---|
| D. 162,123 | 2/1951 | Broeren | 211/50 X |
| 431,080 | 7/1890 | Shute | 100/34 X |
| 944,388 | 12/1909 | Stevenson | 100/212 |
| 944,929 | 12/1909 | Westwood | 100/34 |
| 1,096,356 | 5/1914 | Downey | 100/34 X |
| 2,364,518 | 12/1944 | Clouser | 100/34 |
| 2,927,698 | 3/1960 | Fernly | 211/51 |
| 3,217,461 | 11/1965 | Wheelock | 100/34 X |
| 3,666,115 | 5/1972 | Turner | 211/50 |
| 3,826,186 | 7/1974 | Mechler | 100/34 X |
| 3,887,078 | 6/1975 | Jay | 211/50 |
| 4,091,601 | 5/1978 | Riggins | 100/34 X |
| 4,495,862 | 1/1985 | Davis | 100/34 |
| 4,509,415 | 4/1985 | Stobb | 100/2 |
| 4,964,518 | 10/1990 | Wilson | 100/34 X |
| 5,042,371 | 8/1991 | Katz | 100/34 X |
| 5,161,699 | 11/1992 | Hanna et al. | 211/72 X |

FOREIGN PATENT DOCUMENTS

| | | | |
|---|---|---|---|
| 433888 | 1/1912 | France | 100/212 |
| 379471 | 7/1973 | U.S.S.R. | 100/2 |

*Primary Examiner*—Stephen F. Gerrity
*Attorney, Agent, or Firm*—Shapiro and Shapiro

[57] ABSTRACT

A device for bundling newspapers and the like comprises a pair of upright walls each having an upwardly open substantially V-shaped notch formed by elements of the walls that converge downwardly and that define an interior angle of about 90°, the notches being in parallel alignment. In a preferred embodiment, the walls are longitudinal side walls of a box having upright end walls and having sloping top walls extending between corresponding notch-defining elements of the side walls. Newspapers are stacked on one of the top walls, with an edge thereof engaging the other top wall, and with portions extending beyond the side walls. Cords are tied around those portions to bundle the newspapers. The end walls have openings forming hand holds by which the box is lifted and which provide access to the interior of the box. The box has a shelf therein and contains a supply of cord, a cord cutter being provided along an edge of one opening. A strap may be placed over the stack centrally and is detachably engaged with portions of the top walls.

5 Claims, 2 Drawing Sheets

METHOD FOR BUNDLING NEWSPAPERS

This is a division of application Ser. No. 931,398, filed Aug. 18, 1992.

This invention is concerned with holding and bundling newspapers and the like, as for recycling, for example.

BACKGROUND OF THE INVENTION

As recycling programs have become more popular (in some cases mandatory), the need for a simple, inexpensive, and easily used device for holding and bundling newspapers has become evident. Prior devices for holding and bundling newspapers have been deficient in one or more respects, particularly with regard to complexity, cost, and difficulty or impracticality of use.

BRIEF DESCRIPTION OF THE INVENTION

The present invention provides a device for and a method of holding and bundling newspapers and the like that avoids or overcomes the deficiencies of prior devices and methods for this purpose.

More particularly, in accordance with one of the broader aspects of the invention, a device for bundling newspapers and the like comprises a pair of upright walls, each having a substantially V-shaped upwardly open notch formed along an upper edge thereof, and means for holding said walls spaced from one another with said notches in parallel alignment, each notch being defined by elements forming an interior angle of about 90° for supporting newspapers thereon that extend between and beyond said walls.

In accordance with another of the broader aspects of the invention, a method of bundling newspapers and the like comprises providing a pair of upright walls, each having, at an upper extremity thereof, an upwardly open substantially V-shaped notch, each notch being defined by elements that converge downwardly and that form an interior angle of about 90°, and the notches being in parallel alignment, forming a stack of newspapers extending between and beyond said notches, said stack having a bottom newspaper supported on a first pair of corresponding elements of said notches, each newspaper of the stack having an edge engaging a second pair of corresponding elements of said notches, and embracing said stack with at least one elongated member.

BRIEF DESCRIPTION OF THE DRAWINGS

The invention will be further described in conjunction with the accompanying drawings, which illustrate preferred and exemplary embodiments of the invention, and wherein.

DETAILED DESCRIPTION OF THE INVENTION

Figure 1:
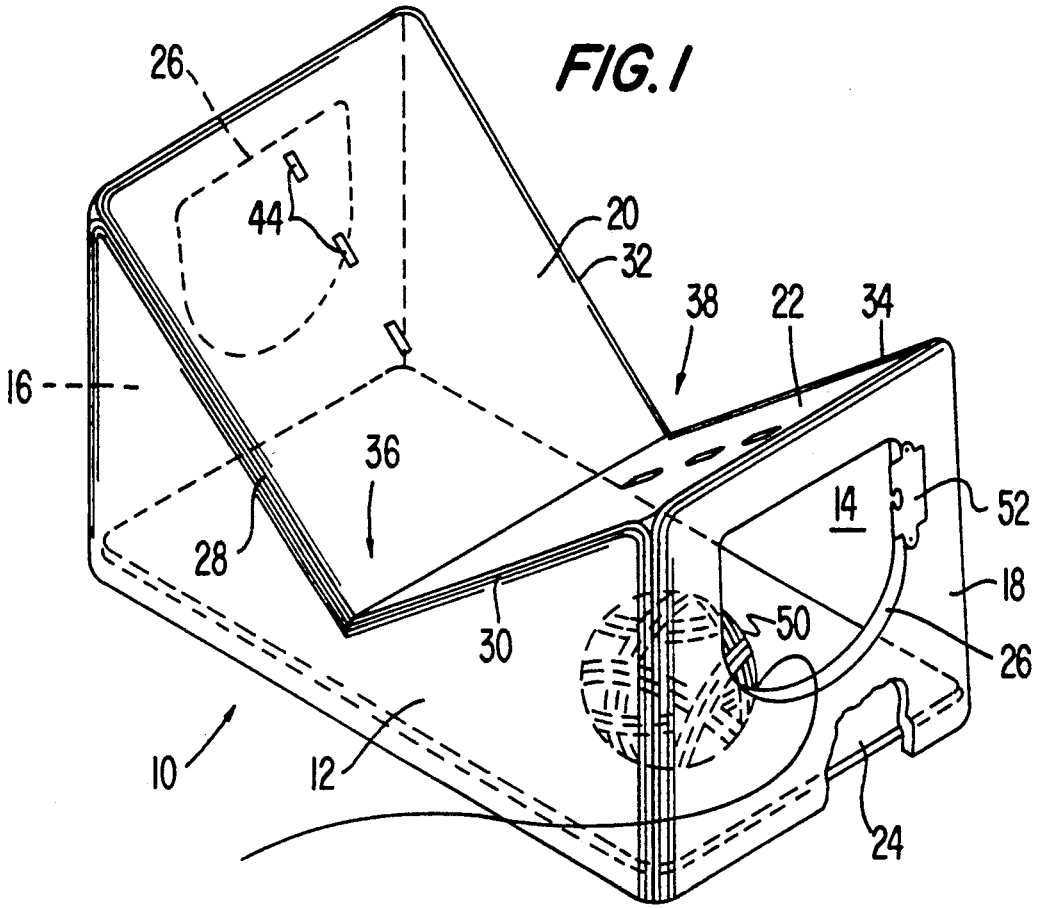
FIG. 1 is a perspective view of a preferred (best mode) embodiment of the invention.

As shown in FIG. 1, a device in accordance with a first embodiment of the invention comprises a box 10 having a pair of upright longitudinal side walls 12 and 14, a pair of upright end walls 16 and 18, and a pair of sloping top walls 20 and 22. The box may be molded of an appropriate plastic material, for example. The hollow interior of the box is provided with a snap-in shelf 24. Each of the end walls has an opening 26 forming a hand hold by which the box may be lifted, and which provides access to the interior of the box.

Each of the side walls has elements 28 and 30 or 32 and 34 forming an upwardly open substantially V-shaped notch 36 or 38 defining an interior angle of about 90°. While the interior angle of the notches is ideally 90°, this angle may vary by a few degrees (e.g., +/−5°), so long as a substantially rectangular stack of newspapers is formed, as later described. The notches are in parallel alignment. In the form of the invention illustrated in FIG. 1, the top walls 20 and 22 extend between and merge with corresponding notch-defining elements 28, 32 or 30, 34 of the side walls and converge downwardly from upper extremities of the end walls, respectively.

Figure 2:
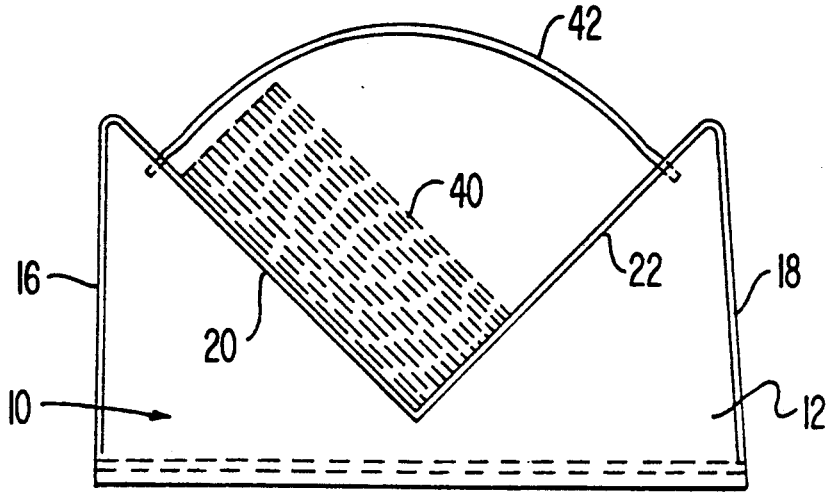
FIG. 2 is a side elevation view illustrating the invention in use.
Figure 4:
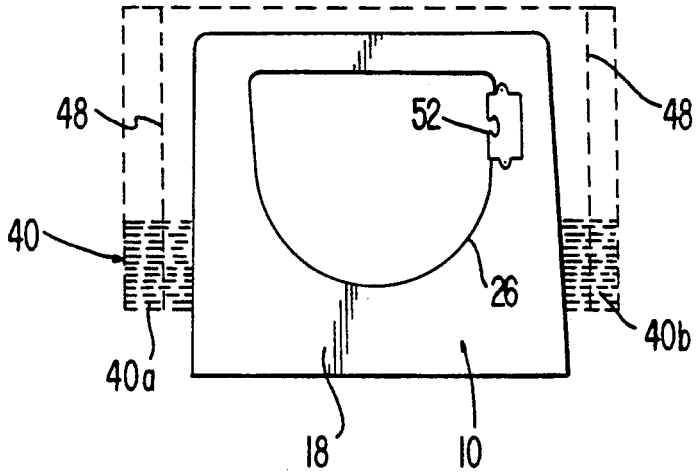
FIG. 4 is an end elevation view illustrating the invention in use.

In use, newspapers 40 and the like are stacked on one of the top walls, e.g., 20. As shown in FIG. 2, a bottom newspaper of the stack rests on top wall 20, and an edge of each stacked newspaper engages the other top wall 22. The distance between the side walls 12 and 14 is preferably such that the newspapers have projecting portions **40*a* and 40*b* that extend beyond the side walls, as shown in FIG. 4**.

Figure 3:
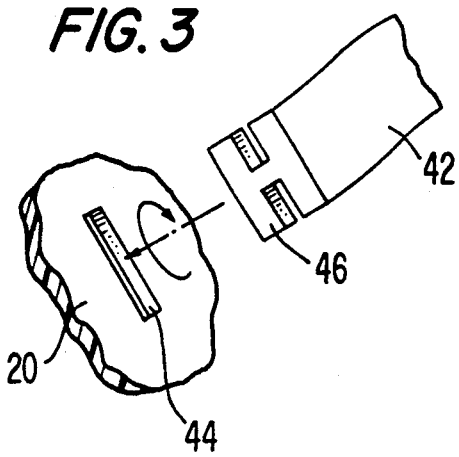
FIG. 3 is a fragmentary perspective view illustrating a detail of the invention.

A flexible (preferably elastic) strap 42 (FIGS. 2 and 3) may be employed for embracing the stack centrally and holding the newspapers in place. In the form shown, each top wall is provided with a series of elongated slots 44, and the strap is provided with an elongated lug 46 at each end adapted to enter and engage one of the slots when aligned therewith and then to be retained in the slot when misaligned therewith, as by turning the lug 90° from its slot entry position, as indicated in FIG. 3. When the lugs at opposite ends of the strap are so engaged and turned, the strap spans the distance between corresponding positions on the top walls and is oriented as shown in FIG. 2. The length of the strap may be made adjustable by well known strap length adjusters.

The device of the invention may be stored in a garage, for example, with newspapers stacked thereon, and at the appropriate time may be carried to a curbside pick-up location. However, in accordance with the preferred embodiment, a stack of newspapers is first tied off to form a bundle that may be lifted unitarily when separated from the bundling device of the invention. For this purpose, cords 48 are tied about and embrace the portions **40*a* and 40*b* of the stack that project beyond the side walls, as shown in FIG. 4. The hollow interior of the box conveniently accommodates a cord supply 50, and a cord cutter 52 is preferably mounted along an edge of one of the openings 26** for cutting appropriate lengths of cord extended from the supply.

Figure 5:
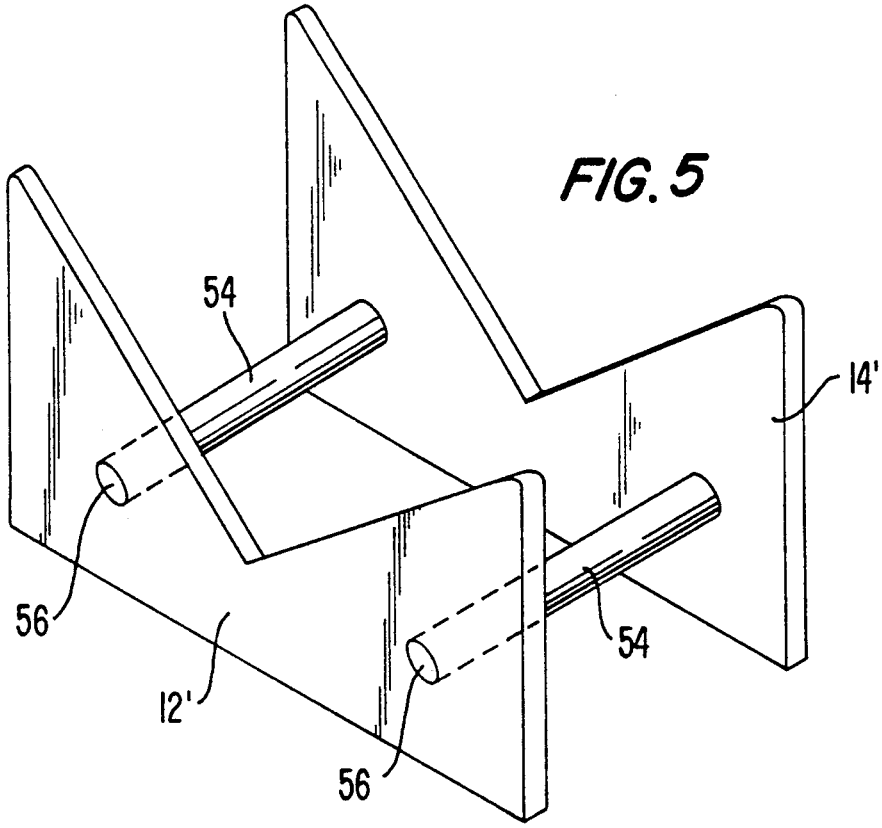
FIG. 5 is a perspective view of another embodiment of the invention.

FIG. 5 illustrates a second, somewhat simpler, embodiment of the invention. In the previously described embodiment, the side walls 12 and 14 are held spaced from one another by the end walls 16 and 18 and the top walls 20 and 22. In the embodiment of FIG. 5, all of the walls except side walls 12' and 14' are eliminated. The side walls are connected by a pair of parallel rods 54. The space between the walls is free and unobstructed, except for the rods, which bridge the space. If desired, the distance between the walls may be adjusted by providing a friction fit between an end of each rod and a corresponding hole 56 in a side wall through which the rod may be adjustably projected. A bundle of newspapers may be formed with the device of FIG. 5 in the manner previously described, but since the space between the walls is open, a cord may be tied about the bundle centrally thereof in addition to or instead of cords tied about portions of the bundle that project beyond the walls.

While preferred embodiments of the invention have been shown and described, it will be apparent to those skilled in the art that changes can be made in these embodiments without departing from the principles and spirit of the invention, the scope of which is defined in the appended claims.

I claim:

1. A method of bundling newspapers comprising providing a pair of opposing upright walls, each having, at an upper extremity thereof, an upwardly open substantially V-shaped notch, each notch being defined by elements that converge downwardly and that form an interior angle of about 90°, and the notches being in parallel alignment with one another, forming a stack of newspapers on top of said notches, said stack extending between and beyond said notches, said stack having a bottom newspaper supported on a first pair of corresponding elements of said notches, each newspaper of the stack having an edge engaging a second pair of corresponding elements of said notches, and embracing said stack with at least one elongated member to bundle said stack.

2. A method according to claim 1, wherein said walls are provided with free space between corresponding elements of said notches.

3. A method according to claim 1, wherein said walls are provided with additional walls extending between and merging with corresponding elements of said notches.

4. A method according to claim 1, wherein the embracing of said stack comprises extending a flexible strap over said stack centrally thereof.

5. A method according to claim 1, wherein the embracing of said stack comprises tying cords around respective portions of said stack that project beyond said notches.

* * * * *